United States Patent [19]

Knappstein et al.

[11] 4,088,233

[45] May 9, 1978

[54] DEVICE FOR PUSHING INCANDESCENT COKE OUT OF THE OVEN CHAMBERS OF HORIZONTAL COKE OVEN BATTERIES

[75] Inventors: Johannes Knappstein; Manfred Strobel, both of Recklinghausen, Germany

[73] Assignee: Firma Carl Still Recklinghausen, Germany

[21] Appl. No.: 799,602

[22] Filed: May 23, 1977

[51] Int. Cl.[2] ..... C10B 33/10; F23K 3/00; B65G 25/04

[52] U.S. Cl. ..... 214/23; 104/243; 104/247; 105/453; 202/262

[58] Field of Search ..... 202/262; 104/242–248; 105/144, 145, 453; 214/23

[56] References Cited

U.S. PATENT DOCUMENTS

| | | | |
|---|---|---|---|
| 406,802 | 7/1889 | Weems | 104/245 |
| 943,665 | 12/1909 | Edwards | 104/242 |
| 1,070,248 | 8/1913 | Haldeman | 104/245 |
| 1,546,620 | 7/1925 | Church | 104/242 |
| 4,021,309 | 5/1977 | Radstake et al. | 202/262 |

FOREIGN PATENT DOCUMENTS

| | | | |
|---|---|---|---|
| 210,246 | 5/1909 | Germany | 214/23 |

*Primary Examiner*—Morris O. Wolk
*Assistant Examiner*—Roger F. Phillips
*Attorney, Agent, or Firm*—McGlew and Tuttle

[57] ABSTRACT

The device for pushing incandescent coke out of individual chambers of a coke oven battery which has a plurality of horizontally arranged coke oven chambers, comprises a trackway of spaced apart inboard and outboard tracks which extend along the length of the coke oven battery and a gantry-like carriage which is movable over the trackway and carries the apparatus for pushing the coke out of the individual batteries. The carriage includes inboard legs which are elastically connected to a platform portion which contains the movable ram and other operating parts and outboard legs which are rigidly connected to the platform. The outboard legs also carry contact pressure mechanisms which connect between the legs and the outboard tracks for distributing horizontal stresses to the tracks.

4 Claims, 3 Drawing Figures

DEVICE FOR PUSHING INCANDESCENT COKE OUT OF THE OVEN CHAMBERS OF HORIZONTAL COKE OVEN BATTERIES

FIELD AND BACKGROUND OF THE INVENTION

This invention relates in general to the construction of coke oven batteries and, in particular, to a new and useful carriage for the ram pusher and associated mechanisms for discharging coke from coke oven batteries, and which includes a platform portion which is supported by inboard legs which are elastically connected and outboard legs which are rigidly connected and which include further mechanism for distributing horizontal stresses to the tracks.

DESCRIPTION OF THE PRIOR ART

Devices for discharging incandescent coke by the use of pusher rams are well known, for example, from the manual by Grosskinsky: "handbuch des Kokereiwesens" (Handbook of the Coking Practice), Vol. 1, Dusseldorf 1954, pages 240 through 256.

In the operation of such pusher machines, experience has frequently been shown that the substructure below the inside rail of the track, as well as the rail itself, suffer considerable damage very rapidly, particularly, if strong horizontal forces act in these areas, while in the respective areas of the outside rail and substructure thereof, which are provided for absorbing the occurring horizontal thrust, no such effects have been observed.

SUMMARY OF THE INVENTION

The present invention is directed to a carriage device for the equipment to discharge coke from individual ovens which is designed in a manner such that any damage to the substructure of the track and of the rails themselves is avoided and repairs are reduced to the usual periodical maintenance, for example, annually.

In accordance with the invention, it is provided that at the inboard side or the side adjacent the battery, the frame members are connected to their supporting legs in an elastic manner for mechanical compliance in a direction opposite to the action of the pusher and, at the outboard side or side remote from the battery, the frame members are connected to their supporting legs rigidly, and that the mechanisms for transmitting the horizontal forces to the substructure of the track are disposed substantially in vertical planes which pass through the axes of the frame members and of the supporting legs thereof. The elastic connection may comprise a movable joint or be effected by incomplete fixing.

With the device of the invention, no notable damages occur in the substructure of the rail adjacent the battery, and horizontal thrust forces which are produced during the operation of pushing the coke out of the oven chambers are securely transmitted to the outside supporting legs and, therefrom, to the substructure of the outer rail. This becomes manifest by the fact that, for example, backup rollers continuously rest against the substructure during the thrust-producing operation, or wedges become fixed in the recesses or notches provided for this purpose. With the use of fixing props, a particular advantage is obtained in accordance with the invention which, after all, also applies to the back-up rollers and fixing wedges. That is, torsional forces no longer occur in the lower portion of the supporting legs and cannot be transmitted to the track wheels and, therefrom, to the rail. These torsional forces have always been produced in cases where the mechanisms for transmitting the horizontal forces to the substructure have been provided off the vertical planes passing through the axes of the frame members or supporting legs.

In accordance with the invention, it is no longer necessary to have the substructure of the inside rail of the track designed for absorbing the horizontal forces exceeding the braking forces or the forces produced by irregular oscillating motion. It is quite satisfactory to lay the rail on timber ties supported by a concrete bed. No further anchoring is needed. The substructure of the outer rail of the track, on the contrary, is designed and anchored in a manner known per se, in order to absorb horizontal forces. The pusher ram is mounted, in a manner known per se, in the central axis of the pushing machine in order to obtain a uniform distribution of the pushing forces.

Accordingly, an object of the invention is to provide a device for pushing incandescent coke out of individual chambers of a coke oven battery which has a plurality of horizontally arranged coke oven chambers which comprises a trackway of spaced apart inboard and outboard tracks extendalong the length of the coke oven battery and a gantry-like carriage including a platform support portion with inboard legs which are adjacent to the coke oven battery and which have wheels engaged with the tracks and which has a flexible connection to the platform and outboard legs which have a rigid connection to the platform and which also carries contact pressure mechanisms for transmitting horizontal forces from the carriage to the track.

A further object of the invention is to provide a device for pushing incandescent coke out of the oven chambers of horizontal coke oven batteries which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
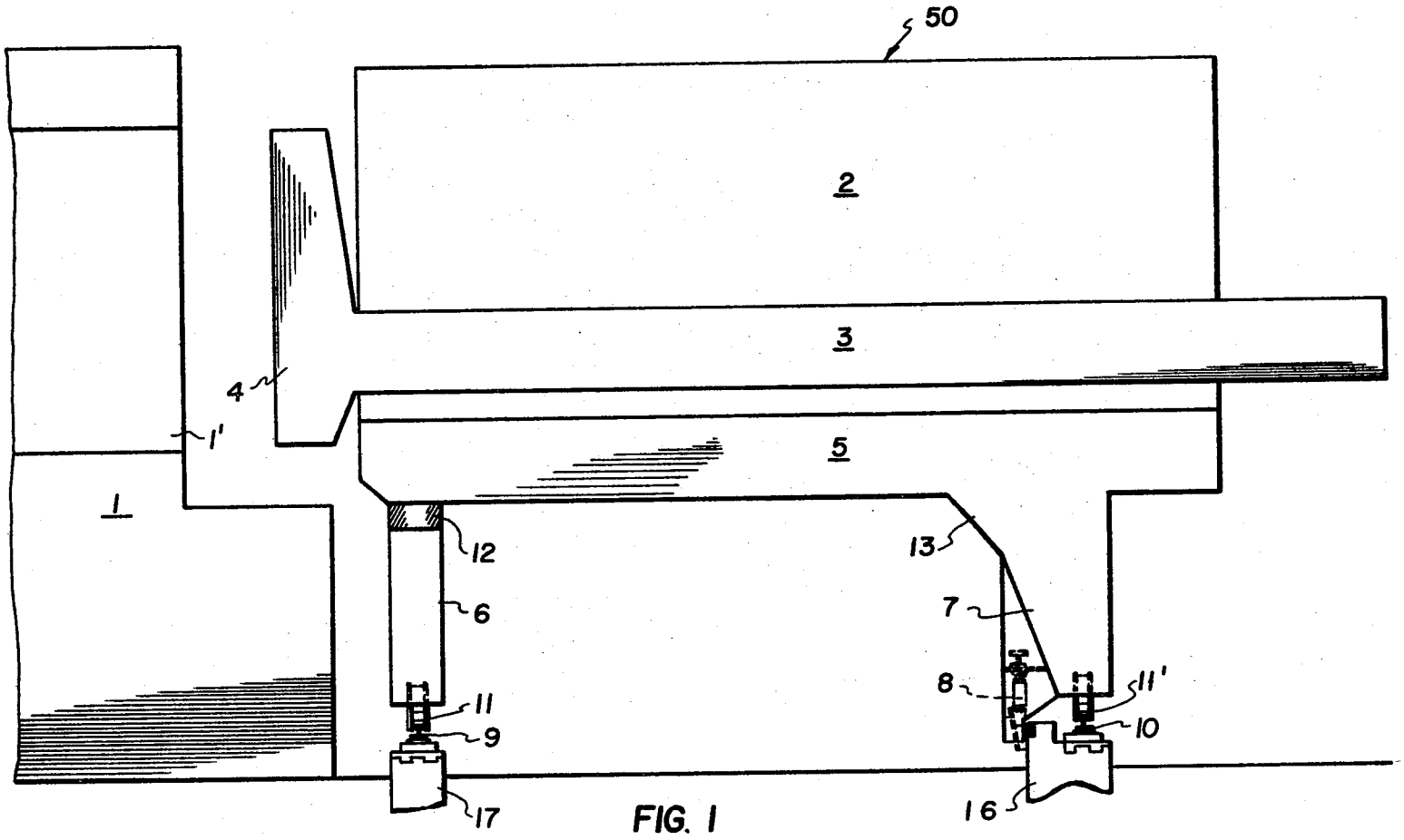
FIG. 1 is a partial side elevational and partial sectional view of an apparatus for pushing coke out of the individual ovens of a coke oven battery, constructed in accordance with the invention.
Figure 2:
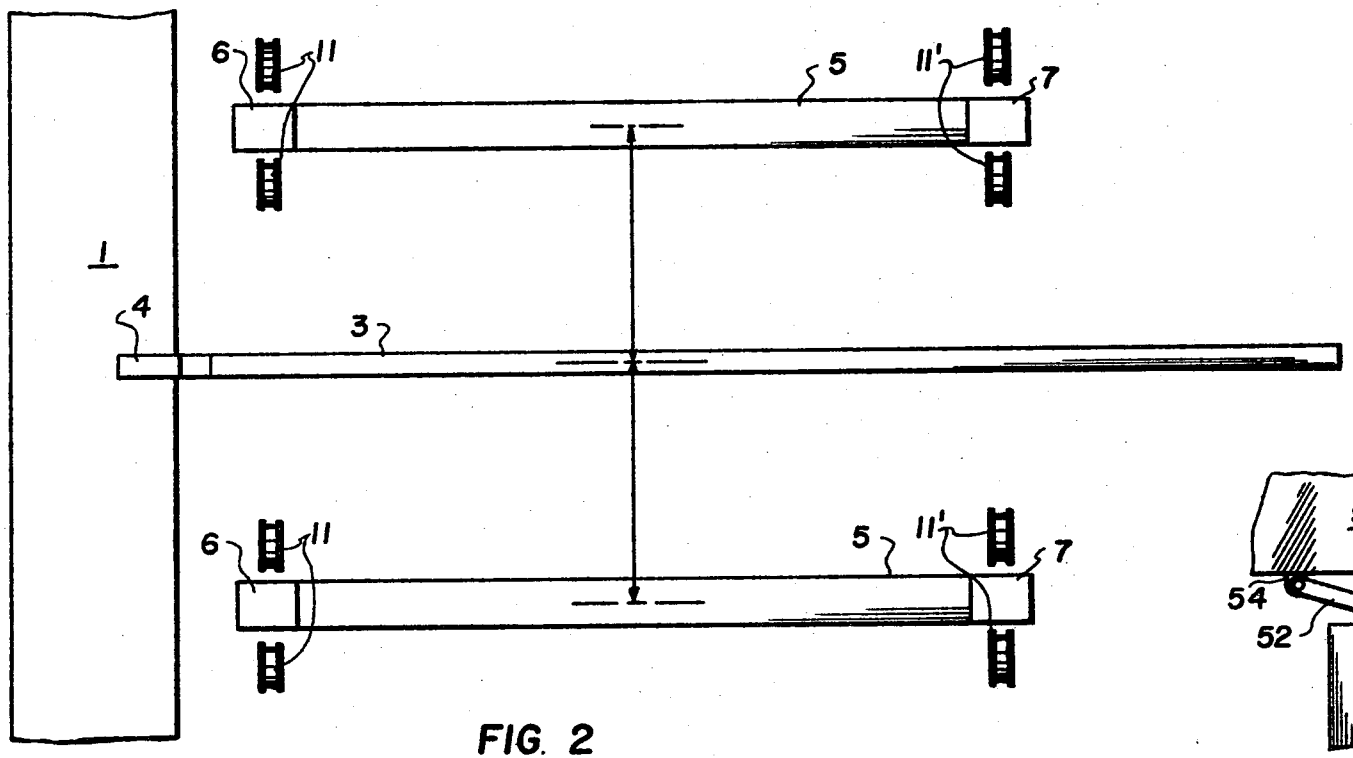
FIG. 2 is a schematic top plan view indicating the central axes of the machine parts and supporting legs.

Referring to the drawings in particular, the invention embodied therein, comprises a device for pushing incandescent coke of individual chambers of a coke oven battery 1, having a plurality of horizontally arranged coke oven chambers.

In accordance with the invention, the device includes a gantry-like carriage, generally designated 50, which includes a platform portion 5 forming a support for a pusher machine 2, which includes a pusher ram 3 having a ram head 4 which is supported on the platform 5 in association with means for displacing it laterally into individual ovens 1' of the coke oven battery 1 in order to discharge the glowing coke therefrom. For this purpose, pushing machine 2 includes the associated mechanism including the leveler bar as well as associated drives and auxiliary equipment for extracting and lodging the oven chamber doors and cleaning the door sealings and the sealing surfaces of the door frames of the individual ovens 1'.

Figure 3:
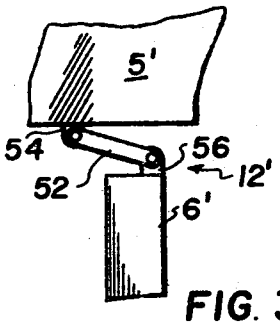
FIG. 3 is a partial elevational view, similar to FIG. 1, of another embodiment of the invention.

In accordance with the invention, carriage 50 includes inboard leg means in the form of supporting legs 6 which are arranged at the side facing the coke oven batteries and which are resiliently connected to the support platform 5 by an elastic connection 12. The elastic connection 12 may comprise a movable joint or may be effected by incomplete fixing providing means such as an intermediate piece 12 of an elastic material. As shown in FIG. 3, the leg 6' is provided with a pivoting support mechanism 12' in the form of a spring link 52 which is secured between brackets 54 and 56 carried on the platform 5' and the leg 6', respectively.

In accordance with a further feature of the invention, the outboard leg means includes an outer supporting leg 7 which is rigidly connected to the support platform 5 at 13. The device also includes contact pressure mechanisms 8 through which the machine rests against the foundation base 16 forming a support for an outer or outboard rail 10. Contact pressure mechanism 8 may, for example, comprise a wheel engaged against the foundation face or a wedge mechanism which may be applied by the predetermined force against the edge face and advantageously it may have a hydraulic or similar fluid-pressure biasing which would provide a stress-relieving distribution of the horizontal forces which act against the foundation base for the outboard rail 10. Outboard wheels 11' carried by the outboard leg 7 engage on the outboard rail 10 and inboard wheels 11 engage on the inboard rails 9 which are mounted on the inboard support structure 17.

While specific embodiments of the invention have been shown and described in detail to illustrate the application of the principles of the invention, it will be understood that the invention may be embodied otherwise without departing from such principles.

What is claimed is:

1. A device for pushing incandescent coke out of individual chambers of a coke oven battery having a plurality of horizontally arranged coke oven chambers, comprising, a trackway of spaced apart inboard and outboard tracks and supports therefor extending along the length of the coke oven battery, a gantry-like carriage including a platform support portion with inboard leg means on the side of said carriage which is adjacent the coke oven battery and having inboard wheel means thereon engaged on the inboard one of said tracks, said platform support portion further having outboard leg means on the side of said carriage remote from the coke oven battery with outboard wheel means engaged on the outboard one of said tracks, flexible connection means connecting said inboard leg means to said platform support portion, rigid connection means connecting said outboard leg means to said platform support portion, ram means carried on said carriage being movable into and out of the individual coke oven chambers of the battery, and a contact pressure mechanism connected between said outboard leg means and said outboard track supports for transmitting horizontal forces from said carriage to said track supports during operation of said ram means.

2. A device, according to claim 1, wherein said outboard track support includes a foundation having a side face facing toward the coke oven battery, said contact pressure mechanism including a member bearing along said side face.

3. A device, according to claim 1, wherein said elastic connection means comprises a movable joint.

4. A device, according to claim 1, wherein said contact pressure mechanism is disposed in a vertical plane.

* * * * *